US006437509B1

(12) United States Patent
Eggers

(10) Patent No.: US 6,437,509 B1
(45) Date of Patent: Aug. 20, 2002

(54) ELECTRODE FOR DISCHARGE LAMPS

(76) Inventor: Thomas Eggers, Ortsstrasse 17, D-88525 Dürmentingen (DE)

( * ) Notice: Subject to any disclaimer, the term of this patent is extended or adjusted under 35 U.S.C. 154(b) by 0 days.

(21) Appl. No.: 09/581,197

(22) PCT Filed: Mar. 4, 1998

(86) PCT No.: PCT/DE98/00624

§ 371 (c)(1),
(2), (4) Date: Jun. 19, 2000

(87) PCT Pub. No.: WO99/33090

PCT Pub. Date: Jul. 1, 1999

(30) Foreign Application Priority Data

Dec. 20, 1997 (DE) ..... 197 57 152

(51) Int. Cl.[7] ..... H01J 17/04; H01J 19/06
(52) U.S. Cl. ..... 313/633; 313/311; 313/332
(58) Field of Search ..... 313/633, 623, 313/624, 625, 331, 332, 335, 333, 311

(56) References Cited

U.S. PATENT DOCUMENTS

| | | | | |
|---|---|---|---|---|
| 2,477,279 | A | | 7/1949 | Anderson |
| 3,244,929 | A | * | 4/1966 | Kuhl ..... 313/311 |
| 3,303,377 | A | | 2/1967 | Jansen et al. |
| 4,038,579 | A | | 7/1977 | Ekkelboom |
| 4,340,836 | A | | 7/1982 | Bergman et al. |
| 4,628,225 | A | | 12/1986 | Keim et al. |
| 5,532,552 | A | | 7/1996 | Heider et al. |

FOREIGN PATENT DOCUMENTS

| | | |
|---|---|---|
| DE | 1187730 | 1/1961 |
| EP | 0639853 | 2/1995 |
| EP | 0756312 | 1/1997 |
| JP | 62241253 | 10/1987 |
| JP | 62241254 | 10/1987 |
| JP | 62243235 | 10/1987 |
| JP | 62249348 | 10/1987 |
| JP | 62249349 | 10/1987 |
| JP | 6052828 | 2/1994 |
| JP | 9231939 | 9/1997 |

* cited by examiner

*Primary Examiner*—Vip Patel
*Assistant Examiner*—Joseph Williams
(74) *Attorney, Agent, or Firm*—Dennison, Schultz & Dougherty

(57) ABSTRACT

The invention relates to an electrode for discharge lamps, comprising a pin which is at least partially surrounded by a solid body. Said solid body consists of a material with a high melting point. The cooling body is therefore easy to mount on the pin and can be solidly connected to the same so that they form a robust unit.

15 Claims, 4 Drawing Sheets

ELECTRODE FOR DISCHARGE LAMPS

BACKGROUND OF THE INVENTION

The invention relates to an electrode for discharge lamps having a pin at least partially surrounded by a solid body.

Electrodes of the type mentioned in the introduction are used in discharge lamps in order to release or receive electrons during a gas discharge. The electrodes each contain a pin, at the free end of which electrons either emerge from the pin or enter it at this end, wherein the pin is generally partially surrounded by a cooling body in the proximity of its free end, which cooling body is usually formed from a wire wound around the pin. It has been shown that both the application of such a cooling body formed from a wound wire on the pin and also a robust attachment of the cooling body to the pin can only be achieved at a high technical cost, wherein the results with respect to a firm attachment of the cooling body to the pin are not satisfactory.

SUMMARY OF THE INVENTION

It is therefore the object of the invention to create an electrode for discharge lamps, wherein the cooling body is applied to the pin in a simple manner and is firmly connected to the pin thereby forming a robust unit.

For an electrode of the type mentioned in the introduction, this object is achieved in that the solid body is produced from a high-melting material.

Preferred embodiments of the invention are the subject of the subordinate claims.

In the electrode in accordance with the invention it is achieved, by the feature of the solid body being formed from a high-melting material, that the solid body also holding the function of a cooling body can be produced as a solid block which can be firmly connected to the pin both by reason of is material composition and also its dimensions.

In accordance with a preferred embodiment of the electrode in accordance with the invention, the solid body is formed from a material which has a melting point above 1800° C.

The solid body is preferably formed from tungsten.

The solid body is preferably in the form of a cylinder in which an axial bore is introduced. The axial bore is dimensioned in such a way that the pin of the electrode can be introduced into the bore. After the pin has been introduced into the axial bore of the solid body, the solid body can be connected to the pin by a number of different methods to form a fixed unit as explained in more detail hereinunder. In accordance with a preferred embodiment of the electrode in accordance with the invention the bore is introduced into the cylinder by means of a laser, in particular a Nd:YAG laser.

In accordance with an important embodiment of the electrode in accordance with the invention, the solid body is composed of a plurality of partial solid bodies disposed one after the other. In this way it is achieved that particularly long electrode bodies in accordance with the invention can be produced which cannot be produced in a single-piece form by reason of the limited penetration depth of a laser beam.

In accordance with another important embodiment of the electrode in accordance with the invention the solid body-side end of the pin is welded to the end of the solid body surrounding it. This welding is preferably carried out by means of a laser, in particular a Nd:YAG or $CO_2$ laser, and brings about the effect that the common end of the pin and of the solid body surrounding it is formed in the manner of a convex cap, of which the edge region forms a transition to the solid body. A cap formed in this way for the electrode in accordance with the invention comprises the advantage that it is particularly effective and resistant to wear.

In accordance with an important embodiment of the electrode in accordance with the invention, the solid body is provided with at least one transverse bore. If a transverse bore of this type is introduced into a solid body before an axial bore is introduced it permits removal to the outside of the vaporisation particles which arise when the axial bore is introduced by means of the laser. The formation of an axial bore by laser beams is thus particularly effective by reason of the rapid escape of the vapour particles thus effected from the region penetrated by laser beams. Furthermore, by means of the introduction of a transverse bore into a solid body, the possibility is created of welding the solid body to the pin at an additional fixing point than just the cap. Alternatively, the possibility is thereby created of welding the solid body to the pin—without welding the cap—only at the locations where transverse bores are provided. The welding of these fixing points is preferably also carried out by laser beams. The introduction of transverse bores into the solid body also makes it possible to introduce or deposit emission pastes into the transverse bores. Emission pastes are generally materials which promote an electron emission of the electrode. In this embodiment of the electrode in accordance with the invention, the solid body therefore fulfills the function of increased electron emission in addition to the cooling function. The emission paste contains, for example thorium oxide.

The bore of the solid body of the electrode in accordance with the invention preferably comprises an inner diameter which is larger than the diameter of the pin, wherein the intermediate space between the solid body and the pin is filled with a melt. The melt preferably contains molybdenum. It is also possible, however, to consider tantalum, niobium, titanium or platinum. In this way a robust connection between the solid body and the pin is created in each case. As an alternative to a melt, the solid body can be shrunk mechanically by means of a plurality of stamps acting inwardly from the outside, to such an extent that it comes into a mechanically firm connection with the pin.

In the case of the electrode in accordance with the invention, the solid body is preferably welded to the pin at one or more fixing points, wherein the corresponding welding process is preferably achieved by laser radiation. A firm mechanical connection between the solid body and the pin is also made possible by a process for directly welding the solid body to the pin, carried out, in particular, at a plurality of fixing points, in the region of common outer contact edges or in the region of transverse bores.

BRIEF DESCRIPTION OF THE DRAWINGS

The electrode in accordance with the invention will be explained hereinunder with the aid of preferred embodiments which are illustrated in the Figures of the drawing in which.

DESCRIPTION OF THE PREFERRED EMBODIMENTS

Figure 1:
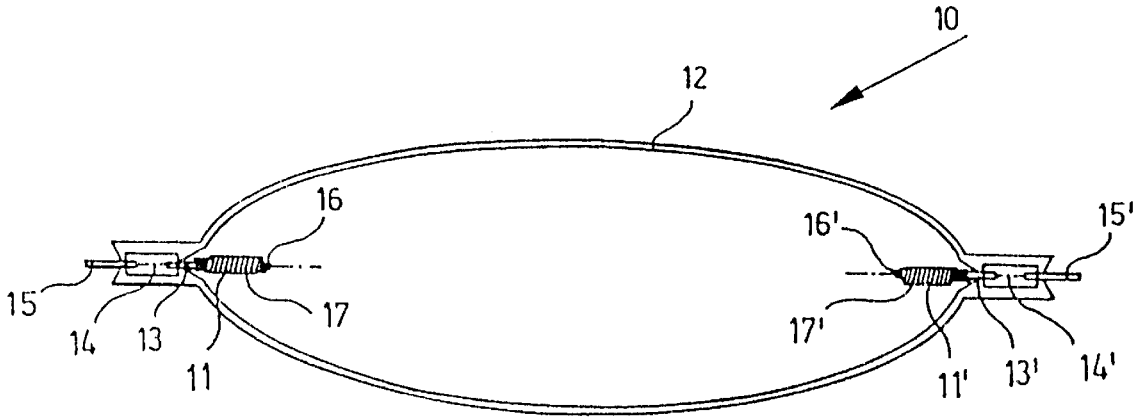
FIG. 1 PRIOR ART
FIG. 1 illustrates a conventional discharge lamp in a transverse cross-sectional view.

In the case of the discharge lamp 10 illustrated in FIG. 1, two electrodes 11, 11' are disposed inside a silica glass bulb 12 in such a way that in each case one end, which is also designated as electrode pin 13, 13', is welded in the glass bulb 12. The electrodes 11, 11' are disposed opposite each other at opposite ends of the bulb 12. The electrode pins 13, 13' are connected by molybdenum foils 14, 14' to molybdenums pins 15, 15' which are each provided for connection to the power supply. The molybdenum foils 14, 14' thus act as power supply elements to the electrode pins 13, 13' inside the glass bulb. The electrodes 11, 11' each also comprise a free electrode end 16, 16' also referred to as a "tip", wherein between the electrode ends 16, 16' an electron exchange can take place in such a way that the respective electrode end emits electrons and the other electrode end forms an input for electrons. The electrodes 11, 11' are each surrounded in the region of their ends 16, 16' by an electrode body or cooling body 17, 17'.

Figure 2:
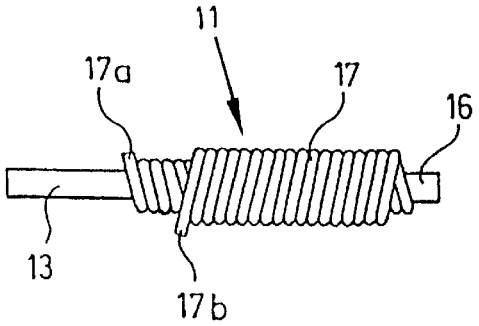
FIG. 2 PRIOR ART
FIG. 2 illustrates a conventional electrode in a side view.

In FIG. 2 a conventional electrode 11 as used in a discharge bulb 12 in accordance with FIG. 1 is illustrated in a side view. The electrode body or cooling body 17 is formed from a wire wound around the electrode pin 13, the ends 17*a* and 17*b* of which are free. As shown in the Figure, the wire can be wound in two layers in respectively different directions.

Figure 3:
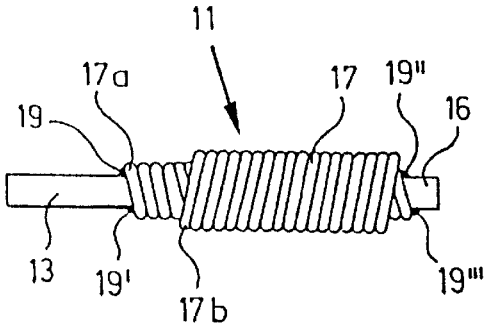
FIG. 3 illustrates a preferred embodiment of the electrode in accordance with the invention, in a transverse cross-sectional view.

In the case of the electrode 11 in accordance with the invention illustrated in FIG. 3, a hollow-cylindrical solid body 17 is provided as the electrode body or cooling body around the relevant part 18 of the electrode pin 13 instead of a wire winding 17 illustrated in FIG. 2. The electrode body 17 is produced overall as a solid block of a solid body which is formed from a high-melting material. The electrode 11 illustrated in FIG. 3 comprises a free electrode end 16.

Figure 4:
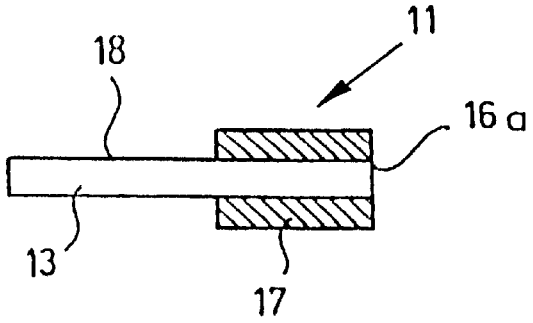
FIG. 4 illustrates a further preferred embodiment of the electrode in accordance with the invention in a transverse cross-sectional view.

In the case of the electrode 11 in accordance with the invention illustrated in FIG. 4, like reference numerals designate like components as in the electrode illustrated in FIG. 3. In contrast to the latter, the electrode 11 illustrated in FIG. 4, however, comprises no separate electrode end 16.

Figure 5:
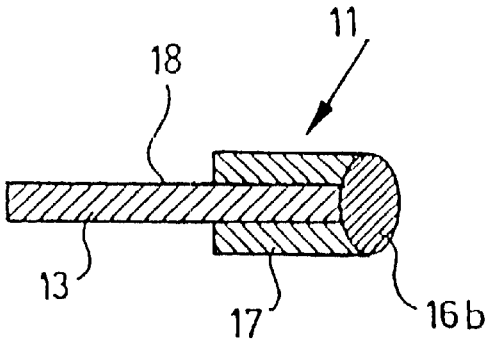
FIG. 5 illustrates a further preferred embodiment of the electrode in accordance with the invention in a transverse cross-sectional view.

As illustrated in FIG. 5 and in accordance with a preferred embodiment of the electrode 11 illustrated in FIG. 4, the "flush" electrode end 16*a* is welded to the electrode body 17 by laser so that an electrode end 16*b* is formed, of which the diameter is formed as an outwardly directed half-sphere in contrast to the electrode end 16 illustrated in FIG. 3, and is enlarged to the diameter of the electrode body 17. In this way a half-spherical cap is formed, wherein the arc in the lamp in each case seeks the shortest path between the electrodes and in the case of caps formed as half-spheres always contacts the highest point thereof, whereas in the case of flat ends it can travel to and fro on the corresponding surface, which leads to an unsteady light. In this embodiment of the electrode in accordance with the invention a particularly high level of consistency in the light intensity given out is therefore observed.

Figure 7:
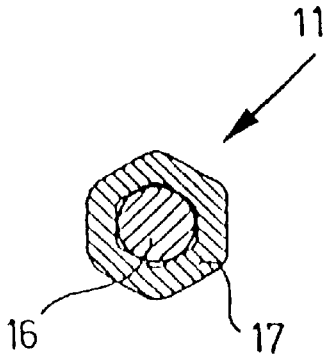
FIG. 7 illustrates a further preferred embodiment of the electrode body in accordance with the invention in a view from the front, after stamping by means of the stamping device shown in FIG. 6.
Figure 6:
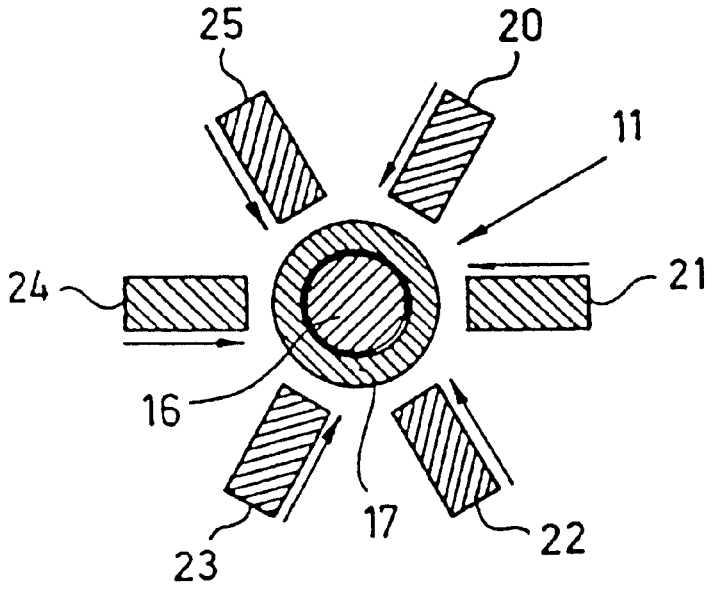
FIG. 6 illustrates a schematic view of a device for stamping an electrode body in accordance with the invention in a view from above.

In the case of the device illustrated in FIG. 6 for the purpose of stamping electrodes, a plurality of stamps 20, 21, 22, 23, 24, 25 are disposed concentrically around an electrode 11. The stamps 20 to 25 can be moved under high pressure in a reciprocal manner in the direction of the arrow by means of a mechanism, not illustrated, wherein the electrode 11 illustrated in transverse cross-section is disposed in the middle of the stamps 20 to 25 in such a way that the stamps 20 to 25 each lie against the electrode body 17 of the electrode 11 at substantially the same moment and then press the electrode body 17 in the direction of the electrode pin 18, each applying the same force, wherein the electrode body 17 with the electrode pin 18 are pressed together to form a unit, with deformation both of the electrode body 17 and also of the electrode pin 18, as shown in the case of a corresponding electrode 11 illustrated in transverse cross-section in FIG. 7.

Figure 8:
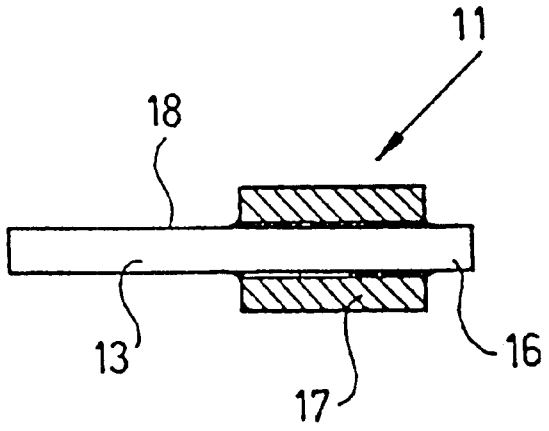
FIG. 8 illustrates a further preferred embodiment of the electrode body in accordance with the invention in a transverse cross-sectional view.

In the case of the embodiment of the electrode in accordance with the invention illustrated in FIG. 8, the electrode body 17 is soldered or welded to the electrode pin 18 using tantalum as the soldering mass. The soldering or welding of electrode bodies 17 to the electrode pin 18 is an alternative process to the process illustrated in FIG. 6, for durably and firmly connecting an electrode body 17 to an electrode pin 18.

Figure 9:
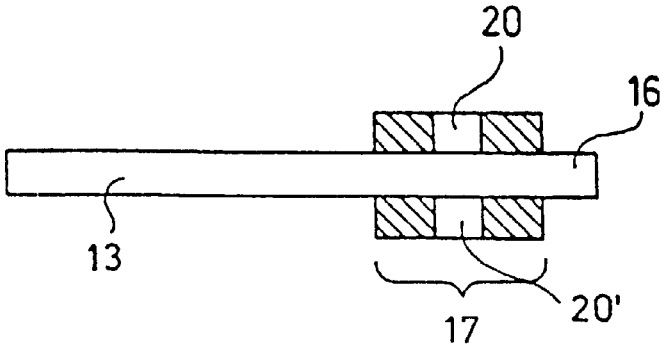
FIG. 9 illustrates a further preferred embodiment of the electrode body in accordance with the invention in a transverse cross sectional view.

In the embodiment of the electrode in accordance with the invention illustrated in FIG. 9, the bore in the solid body 17 comprises an inner diameter which is larger than the diameter of the pin 16, wherein the intermediate space between the solid body 17 and the pin 16 is filled with a melt. The melt contains molybdenum.

Figure 10:
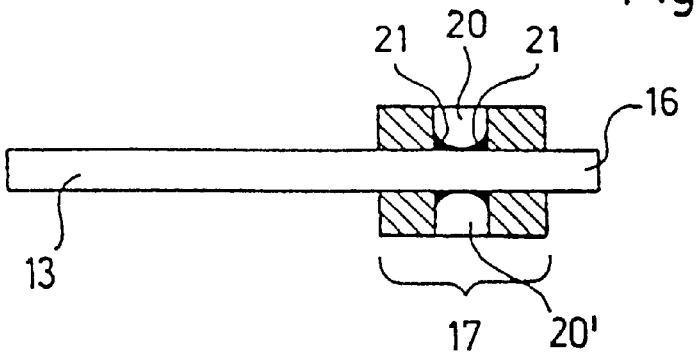
FIG. 10 illustrates a further preferred embodiment of the electrode body in accordance with the invention in a transverse cross-sectional view.

In the case of the embodiment of the electrode in accordance with the invention illustrated in FIG. 10, the electrode body 17 comprises transverse bores 20, 20'. In the case of the embodiment of the electrode in accordance with the invention illustrated in FIG. 11, the electrode body 17 is welded to the electrode pin 13 in the transverse bores 20, 20' in order to comprise better adhesion to the electrode body 13.

Figure 11:
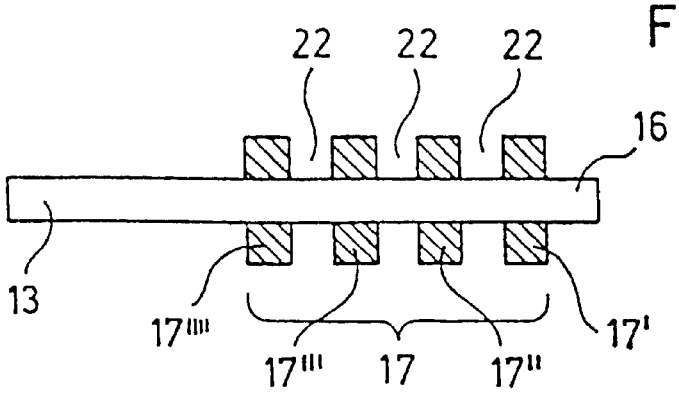
FIG. 11 illustrates a further preferred embodiment of the electrode body in accordance with the invention in a transverse cross-sectional view.

In the case of the embodiment of the electrode in accordance with the invention illustrated in FIG. 11, the electrode body 17 is composed of a plurality of partial solids bodies 17', 17'', 17''' and 17'''' disposed one after the other. Between these partial solid bodies apertures 22 are provided. The dimensions of the apertures 22 can also be larger or smaller than shown in the Figure.

What is claimed is:

1. Electrode for a discharge lamp comprising:

a generally cylindrical solid body of high melting material having a first end and a second end, and an axial bore through the body; and a pin disposed within the axial bore of the solid body such that one end of the pin is flush with the second end;

the second end of the solid body and pin being shaped by laser welding to form a generally convex cap of a diameter which is that of the solid body.

2. Electrode according to claim 1, wherein the material has a melting point above 1800° C.

3. Electrode according to claim 1, wherein the solid body is formed from tungsten.

4. Electrode according to claim 1, wherein the bore is formed by a laser.

5. Electrode according to claim 4, wherein the laser is a Nd:YAG laser.

6. Electrode according to claim 1, wherein the laser is a Nd:YAG laser or a $CO_2$ laser.

7. Electrode according to claim 6, wherein the solid body comprises a plurality of partial solid bodies disposed one after the other.

8. Electrode according to claim 1, wherein the solid body comprises at least one transverse bore.

9. Electrode according to claim 8, wherein an emission paste is introduced into the at least one transverse bore.

10. Electrode according to claim 9, wherein the emission paste contains thorium oxide.

11. Electrode according to claim 1, wherein the bore has an inner diameter which is larger than the diameter of the pin, wherein an intermediate space between the solid body and the pin is filled with a melt.

12. Electrode according to claim 11, wherein the melt contains a molybdenum.

13. Electrode according to claim 1, wherein the bore has an inner diameter larger than the diameter of the pin, wherein an intermediate space between the solid body and the pin is shrunk mechanically by means of a plurality of stamps acting inwardly from outside.

14. Electrode according to claim 1, wherein the solid body is welded to the pin at one or more fixing points.

15. Electrode according to claim 14, wherein the at least one fixing point is produced by means of a laser.

* * * * *